US008556467B1

(12) United States Patent
Lin

(10) Patent No.: US 8,556,467 B1
(45) Date of Patent: Oct. 15, 2013

(54) LIGHT UNIT WITH HEAT DISPENSING DEVICE

(76) Inventor: Tung-Hsiung Lin, Taichung (TW)

( * ) Notice: Subject to any disclaimer, the term of this patent is extended or adjusted under 35 U.S.C. 154(b) by 181 days.

(21) Appl. No.: 13/292,152

(22) Filed: Nov. 9, 2011

(51) Int. Cl.
*F21V 29/00* (2006.01)

(52) U.S. Cl.
USPC ..... 362/294; 362/249.02; 362/311.02; 311/46

(58) Field of Classification Search
USPC ..... 362/294, 249.02, 311.02, 373, 249.01, 362/235; 313/46
See application file for complete search history.

(56) References Cited

U.S. PATENT DOCUMENTS 7,661,854 B1 * 2/2010 Yang et al. ..... 362/373
2009/0237891 A1 * 9/2009 Liu et al. ..... 361/714
2010/0053964 A1 * 3/2010 Yang et al. ..... 362/249.02
2010/0103666 A1 * 4/2010 Chang et al. ..... 362/234
2011/0121704 A1 * 5/2011 Wang et al. ..... 313/46

* cited by examiner

*Primary Examiner* — Ali Alavi
(74) *Attorney, Agent, or Firm* — Pro-Techtor Int'l Services

(57) ABSTRACT

A light unit includes a tubular part, a shade, a collar, a connector, a circuit board unit and a cover. The tubular part has a flange with multiple first holes and multiple outer fins are located on the outside of the tubular part. A lip extends from the top opening of the shade and second holes are defined through the lip. The shade is mounted to the tubular part to rest the lip on the flange. The collar further has third holes and is mounted to the tubular part. The connector is fixed to the top of the tubular part and Light Emitting Diodes are connected to the circuit board unit and located in the tubular part. The cover is connected to the lower end of the shade. The heat generated by the Light Emitting Diodes is released via the first, second and third holes.

7 Claims, 5 Drawing Sheets

LIGHT UNIT WITH HEAT DISPENSING DEVICE

FIELD OF THE INVENTION

The present invention relates to light unit with a heat dispensing device, and more particularly, to a light heat with a heat dispensing device of high efficiency.

BACKGROUND OF THE INVENTION

A conventional light unit using Light Emitting Diodes (LEDs) is directly connected to the inside of the shade and the LEDs generate heat during operation. However, the conventional shade does not have good heat dispensing feature so that the shade traps the heat in the shade and the high temperature of the shade may burn the users. The high temperature may reduce the life of the LEDs.

The present invention intends to provide a light unit with a heat dispensing device and the heat dispensing device improves the shortcomings of the conventional light units.

SUMMARY OF THE INVENTION

The present invention relates to a light unit and comprises a tubular part having a flange extending, outward from the outside thereof and multiple first holes are defined through the flange. A shade has outer fins on the outside thereof and the inner funs are located on the inside of the shade. A lip extends inward from the periphery of the top opening of the shade and the lip has second holes which are located corresponding to the first holes. The shade is mounted to the tubular part so that the lip is rested on the flange. A collar has third holes which are located corresponding to the second holes of the shade. The collar is mounted to the tubular part and contacts the top of the collar. A connector is fixed to the top of the tubular part. A circuit board unit has multiple lighting members connected thereto. The circuit board unit is located in the tubular part and electrically connected to the connector. A cover is connected to the lower end or the shade.

Preferably, the tubular part includes outer threads and the connector includes inner threads which care threadedly connected to the outer threads.

Preferably, the tubular part includes multiple ridges on the outside thereof.

Preferably, the cover is a semi-spherical cover.

Preferably, the cover is a flat cover.

Preferably, the lighting members are Light Emitting Diodes.

Preferably, the light unit has a base with a first board, a second board and a third board. The first board is connected to the circuit board unit and the lighting members are connected to the second and third boards. Each of the inner fins has a first contact portion and a second contact portion at the lower end thereof. The second and third boards are engaged with the first and second contact portions respectively.

The primary object of the present invention is to provide a light unit which has a heat dispensing device which can quickly release the heat generated from the light members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
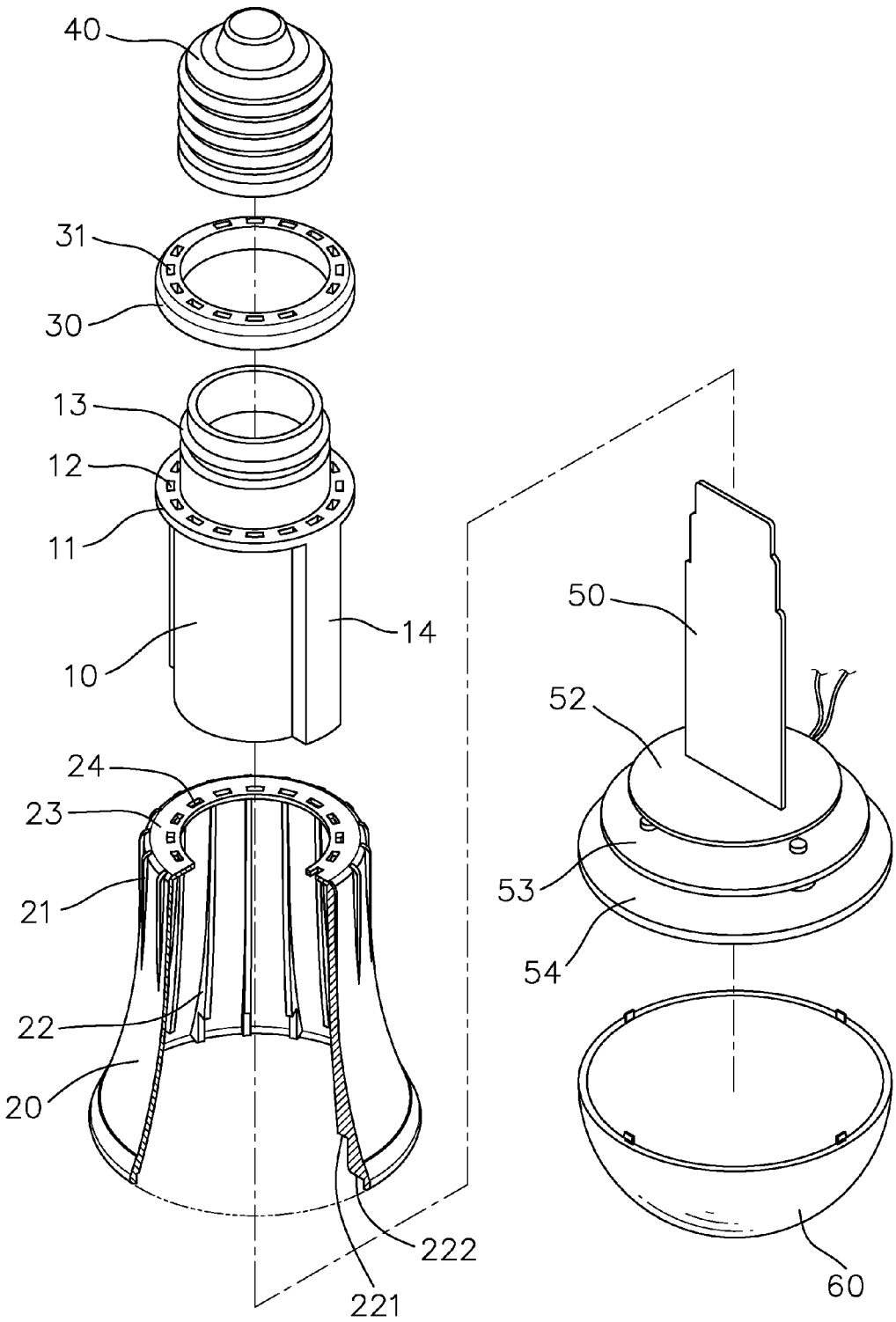
FIG. 1 is an exploded view to show the light unit of the present invention.
Figure 2:
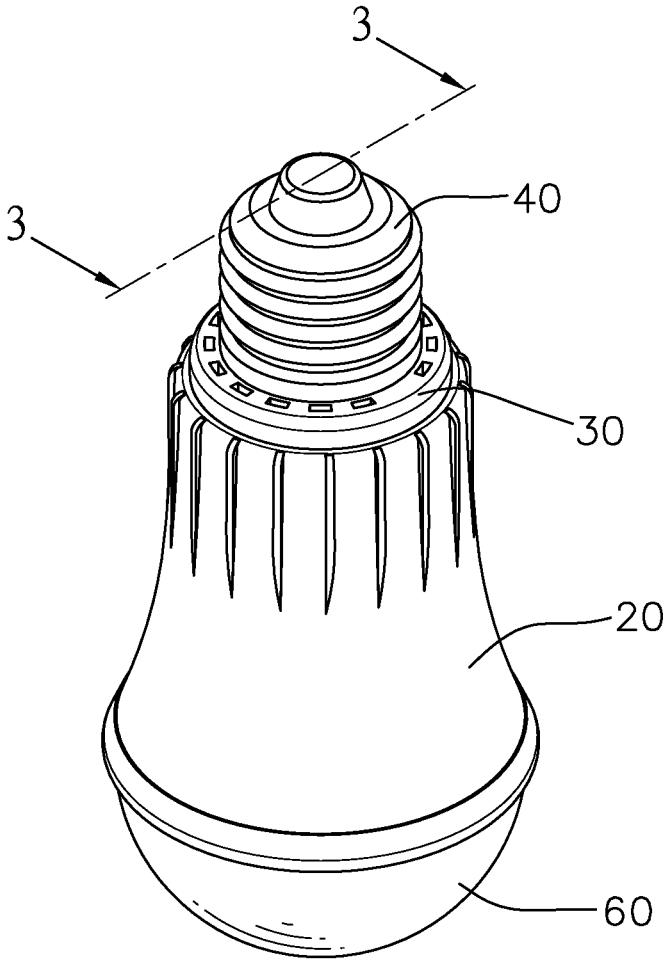
FIG. 2 is a perspective view to show the lift unit of the present invention.
Figure 3:
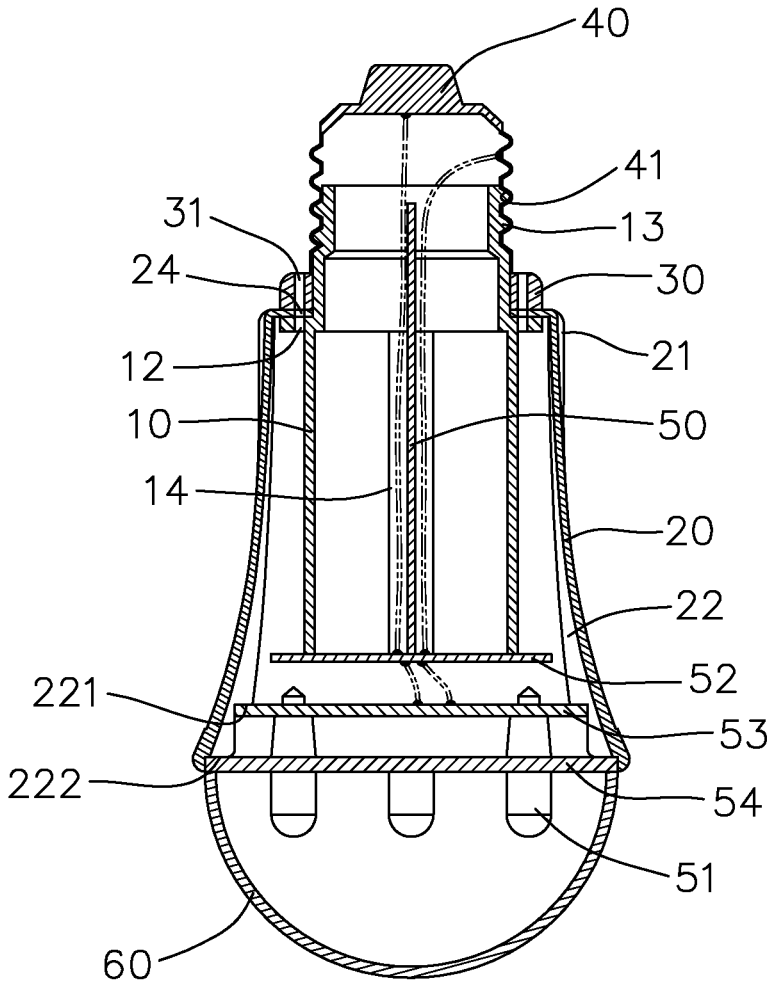
FIG. 3 is a cross sectional view, taken along line 3-3 of FIG. 2.

Referring to FIGS. 1 to 5, the light unit of the present invention comprises a tubular part 10 having a flange 11 extending outward from the outside thereof and multiple First holes 12 are defined through the flange 11. A shade 20 is mounted to the tubular part 10 and has outer tins 21 on the outside thereof. Multiple inner tins 22 are located on the inside of the shade 20. A lip 23 extends inward from the periphery of the top opening of the shade 20. The lip 23 has second holes 24 which are located corresponding to the first holes 12. When the shade 20 is mounted to the tubular part 10, the lip 23 is rested on the flange 11.

A collar 30 has third holes 31 which are located corresponding to the second holes 24 of the shade 20. The collar 30 is mounted to the tubular part 10 and contacts the top of the collar 30. A connector 40 is fixed to the top of the tubular part 10.

A circuit board unit 50 has multiple lighting members 51 connected thereto. The circuit board unit 50 is located in the tubular part 10 and electrically connected to the connector 40. A cover 60 is connected to a lower end of the shade 20.

The tubular part 10 includes outer threads 13 and the connector 40 includes inner threads 41 which care threadedly connected to the outer threads 13. The tubular part 10 includes multiple ridges 14 on the outside thereof. The cover 60 is a semi-spherical cover or a flat cover. The lighting members 51 are Light Emitting Diodes.

The light unit includes a base having a first board 52, a second board 53 and a third board 54. The first board 52 is connected to the circuit: hoard unit 50 and the lighting members 51 are connected to the second and third boards 53, 54. Each of the inner fins 22 has a first contact portion 221 and a second contact: portion 222 at a lower end thereof. The second and third boards 53, 54 are engaged with the first and second contact portions 221, 222 respectively when the circuit hoard unit 50 is installed in the tubular part 10.

Figure 4:
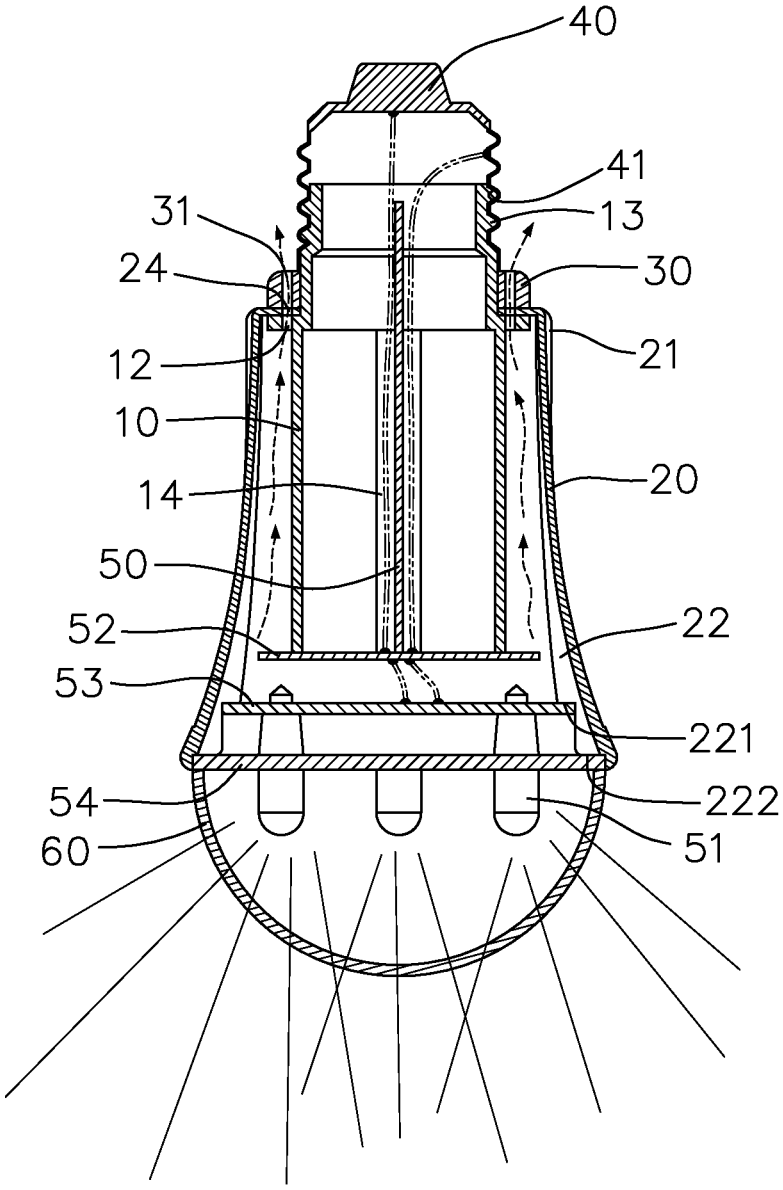
FIG. 4 shows heat is dispensed from the light unit.
Figure 5:
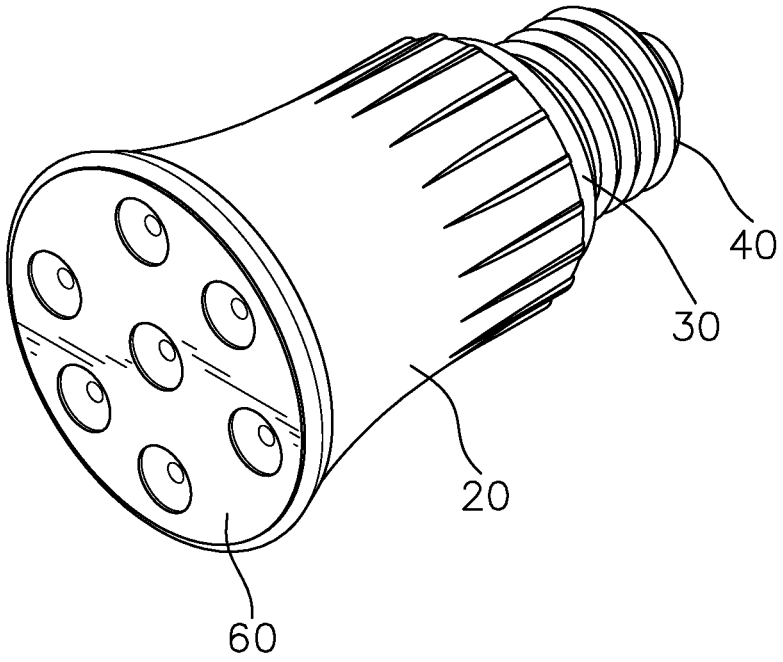
FIG. 5 shows another embodiment of the light unit of the present invention.

When the lighting members 51 generate heat, the heat is conducted to the outer fins 21 and the inner fins 22 on the shade 20 and the heat is released to the air. The first, second and third holes 12, 24, 31 are located in alignment with each other, so that the heat can be released via the path formed by the first, second and third holes 12, 24, 31 as shown in FIG. 4.

Thanks to the tubular part 10, the circuit board unit 50 is located in the tubular part 10, and the circuit board unit 50 is separated from the rest of wires of the light unit so that the heat flows are not impeded or affected.

The light unit with the heat dispensing device can efficiently remove the heat from the light unit so that the life of use of the lighting members 51 is not shortened.

While we have shown and described the embodiment in accordance with the present invention, it should be clear to those skilled in the art that further embodiments CMS may be made without departing from the scope of the present invention.

What is claimed is:

1. A light unit comprising:

a tubular part having a flange extending outward from an outside thereof, multiple first holes defined through the flange;

a shade having outer fins on an outside thereof and the inner fins located on an inside of the shade, a lip extending inward from a periphery of a top opening of the shade, the lip having second holes which are located corresponding to the first holes, the shade mounted to the tubular part so that the lip is rested on the flange;

a collar having third holes which are located corresponding to the second holes of the shade, the collar is mounted to the tubular part and contacting a top of the collar;

a connector fixed to a top of the tubular part;

a circuit board unit having multiple lighting members connected thereto, the circuit board unit located in the tubular part and electrically connected to the connector, and a cover connected to a lower end of the shade.

2. The light unit as claimed in claim 1, wherein the tubular part includes outer threads and the connector includes inner threads which care threadedly connected to the outer threads.

3. The light unit as claimed in claim 1, wherein the tubular part includes multiple ridges on the outside thereof.

4. The light unit as claimed in claim 1, wherein the cover is a semi-spherical cover.

5. The light unit as claimed in claim 1, wherein the cover is a flat cover.

6. The light unit as claimed in claim 1, wherein the lighting members are Light Emitting Diodes.

7. The light unit as claimed in claim 1 further comprising a base with a first board, a second board and a third board, the first board connected to the circuit board unit and the lighting members connected to the second and third boards, each of the inner fins having a first contact portion and a second contact portion at a lower end thereof, the second and third boards engaged with the first and second contact portions respectively.

* * * * *